US010062283B2

(12) United States Patent
Mielenz

(10) Patent No.: US 10,062,283 B2
(45) Date of Patent: Aug. 28, 2018

(54) DEVICE AND METHOD FOR OPERATING A PARKING LOT

(71) Applicant: Robert Bosch GmbH, Stuttgart (DE)

(72) Inventor: Holger Mielenz, Ostfildern (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 14/956,647

(22) Filed: Dec. 2, 2015

(65) Prior Publication Data

US 2016/0155331 A1 Jun. 2, 2016

(30) Foreign Application Priority Data

Dec. 2, 2014 (DE) ..... 10 2014 224 601

(51) Int. Cl.
*G08G 1/14* (2006.01)

(52) U.S. Cl.
CPC ..... *G08G 1/14* (2013.01); *G08G 1/146* (2013.01)

(58) Field of Classification Search
CPC ..... G08G 1/14; G08G 1/143
USPC ..... 340/932
See application file for complete search history.

(56) References Cited

U.S. PATENT DOCUMENTS 4,392,119 A * 7/1983 Price ..... G08G 1/065 336/84 M
5,389,921 A * 2/1995 Whitton ..... E01F 9/594 248/156
9,581,997 B1 2/2017 Penilla et al.
2008/0136674 A1 6/2008 Jang et al.
2010/0284771 A1* 11/2010 Stierler ..... E04H 6/422 414/234
2013/0166190 A1* 6/2013 Ikeda ..... B62D 15/0285 701/400

(Continued)

FOREIGN PATENT DOCUMENTS

DE 10 2012 222 562 6/2014
JP 2016006603 A 1/2016

OTHER PUBLICATIONS

Muhammet Balcilar; A. Coskun Sonmez; "Extracting vehicle density from background estimation using Kalman filter," 2008 23rd International Symposium on Computer and Information Sciences; Year: 2008; pp. 1-5.*

(Continued)

*Primary Examiner* — Nader Bolourchi
(74) *Attorney, Agent, or Firm* — Norton Rose Fulbright US LLP; Gerard Messina

(57) ABSTRACT

A device for operating a parking lot, includes a communication interface, which is configured to receive a parking inquiry for a vehicle in the parking lot from a user of a communication network via the communication network, and a processor, which, in response to the received parking inquiry, configured to ascertain a parking position in the parking lot for the vehicle based on an instantaneous and/or expected number of vehicles situated in an entrance area of the parking lot, the communication interface being configured to transmit the ascertained parking position via the communication network to the user so that the vehicle may park in the ascertained parking position. Also described is a method for operating a parking lot and a computer program therefor.

10 Claims, 3 Drawing Sheets

(56) References Cited

U.S. PATENT DOCUMENTS

| | | | | |
|---|---|---|---|---|
| 2015/0168155 | A1* | 6/2015 | You | H04N 7/183<br>701/409 |
| 2015/0353080 | A1* | 12/2015 | Mukaiyama | E05B 77/54<br>701/23 |

OTHER PUBLICATIONS

Tahere Royani; Javad Haddadnia; MohammadReza Pooshideh: "A simple method for calculating vehicle density in traffic images," 6th Iranian Conference on Machine Vision and Image Processing, 2010, pp. 1-4.*

* cited by examiner

DEVICE AND METHOD FOR OPERATING A PARKING LOT

RELATED APPLICATION INFORMATION

The present application claims priority to and the benefit of German patent application no. 10 2014 224 601.6, which was filed in Germany on Dec. 2, 2014, the disclosure of which is incorporated herein by reference.

FIELD OF THE INVENTION

The present invention relates to a device and to a method for operating a parking lot. The present invention further relates to a computer program.

BACKGROUND INFORMATION

In the case of fully automated (autonomous) so-called valet parking, a driver parks the vehicle in a drop-off spot, for example in front of a parking garage, and from there the vehicle drives itself into a parking position/parking space and back to the drop-off spot. The driver may remain in the vehicle or leave the same during the valet parking.

Unexamined patent application DE 10 2012 222 562 A1 refers to a system for managed parking areas for transferring a vehicle from a starting position into a destination position.

For example, a back-up in front of a parking lot or in the entrance area of the parking lot including such parking areas may occur if many vehicles want to simultaneously park autonomously in the parking lot and the lot is not sufficient to cope with the number of vehicles.

SUMMARY OF THE INVENTION

It is thus the object of the present invention to provide a device for operating a parking lot which prevents, or at least reduces, a back-up in front of the parking lot or in the entrance area of the parking lot due to vehicles to be parked.

It is another object of the present invention to provide a corresponding method for operating a parking lot.

It is yet another object of the present invention to provide a corresponding computer program.

These objects are achieved with the aid of the respective subject matter of the descriptions herein. Advantageous embodiments of the present invention are the subject matter of the respective further descriptions herein.

According to one aspect, a device for operating a parking lot is provided, including:

- a communication interface, which is configured to receive a parking inquiry for a vehicle on the parking lot from a user of a communication network via the communication network;
- a processor, which, in response to the received parking inquiry, configured to ascertain a parking position on the parking lot for the vehicle based on an instantaneous and/or expected number of vehicles situated in an entrance area of the parking lot;
- the communication interface being configured to transmit the ascertained parking position via the communication network to the user so that the vehicle may park in the ascertained parking position.

According to another aspect, a method for operating a parking lot is provided, in which:

- a parking inquiry for a vehicle in the parking lot is received from a user of a communication network via the communication network;

- in response to the received parking inquiry, a parking position in the parking lot being ascertained for the vehicle based on an instantaneous and/or expected number of vehicles situated in an entrance area of the parking lot;
- the ascertained parking position being transmitted via the communication network to the user so that the vehicle may park in the ascertained parking position.

According to another aspect, a computer program is provided, which includes program code for carrying out the method for operating a parking lot if the computer program is executed on a computer.

The present invention thus includes in particular the idea of ascertaining a parking position for the vehicle as a function of an instantaneous and/or expected number of vehicles situated in the entrance area of the parking lot. This in particular achieves the technical advantage that a concrete situation and/or an expected situation is/are taken into consideration in the selection of the parking position. In this way, advantageously a holding time of additional arriving or already present vehicles may be avoided or minimized. By avoiding a holding time or minimizing the holding time, a back-up may be advantageously prevented or at least be reduced. The core of the present invention is thus in particular that a selection regarding which parking position of the multiple parking positions of the parking lot is assigned to the vehicle is dependent on how many vehicles are presently situated in the entrance area and/or how many vehicles are still to be expected in the entrance area, in particular for a predetermined time period.

An entrance area within the meaning of the present invention may in particular include the following: an access road to a parking facility, i.e., the parking lot, which, for example, is already a facility involving stationary traffic, but may also be an area of public traffic. In particular, the entrance area includes a beginning of the area as of which a parking activity or a parking service may be offered or carried out, for example with the aid of a service or a service business.

According to one specific embodiment, it is provided that a digital map of the parking lot is transmitted to the user and/or to the vehicle via the communication network. Based on the digital map, it is in particular provided that the vehicle autonomously drives or navigates in the parking lot, in particular drives to the parking position. In particular a trajectory in the parking lot is planned (for example, the trajectory is planned in the vehicle), which the vehicle may follow or follows.

In one specific embodiment, it is provided that a trajectory which the vehicle is to follow in the parking lot, i.e., a setpoint trajectory, is ascertained or planned on a vehicle-external server, this setpoint trajectory may be provided to the vehicle via the communication network. In particular, knowledge about required driving times and a throughput requirement is present on such a vehicle-external server, which is why the vehicle should advantageously receive the trajectory for reaching the parking position from the server.

This means that, according to one specific embodiment, a digital map of the parking lot is also transmitted to the vehicle, in addition to the parking position, so that the vehicle itself may calculate a route to the parking position, or the route to the parking position is calculated by the vehicle-external server and transmitted to the vehicle.

Such a server in particular includes the device according to the present invention.

According to one specific embodiment, it is provided that the processor is configured to ascertain the parking position in that the processor assigns to every possible parking position on the parking lot a length of time for reaching the same starting from the entrance area, and by assigning to every trajectory point of a trajectory leading from the entrance area to the particular parking position a point in time at which a vehicle will pass the same following a start, that parking position being selected as the parking position to be transmitted from the possible parking positions in such a way that the vehicle of the parking inquiry does not block a driving area of a following vehicle when the same crosses a trajectory point of the vehicle of the parking inquiry. As a result of the knowledge of how long it takes until a possible parking position may be reached, and with the knowledge of the point in time at which, following the start, the vehicle passes the individual trajectory points of the trajectory, it is thus possible to select the parking position in such a way that the vehicle, which may also be referred to as the present vehicle, does not still block the driving area of the following vehicle when the same crosses a trajectory point of the present vehicle. It may be ascertained how many following vehicles are present or expected in the approach area or entrance area, the trajectories of the preceding vehicles being optimized as a function of this ascertainment.

Advantageously, knowledge is thus ascertained (length of time for reaching the space and the points in time assigned to the trajectory points), with the aid of which it is advantageously possible that the vehicle no longer represents an obstacle for following vehicles when the vehicles are driving to their respective parking positions. The following vehicle thus no longer has to wait until its driving area is clear. This avoids a holding time for this following vehicle, and thus also for further vehicles following this following vehicle. Holding times may result, for example, in the case of too early multi-point parking maneuvers.

According to one specific embodiment, it is provided that the processor is configured to ascertain the parking position in that the processor selects, from every possible parking position on the parking lot, that parking position as the parking position to be transmitted which is situated behind a nodal point different from a nodal point situated in front of a parking position for a prior vehicle of a prior parking inquiry.

As was already described above in conjunction with the specific embodiment including the ascertainment of the above-mentioned knowledge, this also makes it possible for a driving area for a following vehicle to be clear and not be blocked by the vehicle. The corresponding advantages are derived analogously.

A nodal point within the meaning of the present invention is in particular an intersection, a ramp, an access, or a junction. A nodal point is in particular a traffic nodal point which gives a parking lot management system (or parking lot administration system) the option to guide vehicles to different parking lot areas (parking positions) and allow them to park "undisturbed." Traffic nodal points may thus be intersections, turnoffs, ramps (—>since floor change), vehicle (in particular car) elevators, stacking systems, or the like.

In another specific embodiment, it is provided that the processor is configured to compare the instantaneous and/or expected number of vehicles in the entrance area to a predefined threshold value, the processor being configured to ascertain the parking position corresponding the two above-described specific embodiments based on the comparison.

This in particular achieves the technical advantage that the optimal ascertainment method for the parking position is selected as a function of the number of vehicles in the entrance area. In this way, a back-up may also advantageously be prevented or at least be reduced.

The threshold value may be a decision-making measure of how the vehicles in the parking garage (in general, on the parking lot) are guided to different nodal points as a function of the number of waiting vehicles and/or vehicles to be expected. For example, a drop-off area, a so-called drop zone, has four waiting spots. Three of them are presently already occupied. There are free parking positions in front of a first nodal point, but parking the first vehicle would take three minutes.

The first two vehicles are then sent or guided to parking positions which are more remote or located farther away (i.e., each via an independent nodal point), and the last, i.e., the third, vehicle is guided to the parking positions in front of the first nodal point and parked there.

It is thus in particular provided that the parking position is ascertained corresponding to the specific embodiment including the above-described knowledge if the instantaneous and/or expected number of vehicles in the entrance area is greater or smaller, or only smaller, than the predefined threshold value. It is thus in particular provided that the processor is configured to ascertain the parking position corresponding to the specific embodiment including the nodal points when the instantaneous and/or expected number of vehicles in the entrance area is greater than, or greater than or equal to, a predefined threshold value.

In a further specific embodiment, it is provided that the processor is configured to ascertain a respective new parking position for parked vehicles as a function of a capacity utilization of the parking lot.

According to one further specific embodiment, it is provided that the communication interface is configured to transmit the new parking positions (and/or a respective new trajectory to the new parking positions) via the communication network to the parked vehicles, so that the parked vehicles may autonomously re-park corresponding to the new parking position.

This in particular achieves the technical advantage that a parking distribution of parked vehicles may also be changed subsequently, i.e., after these have already been parked, for example to advantageously minimize a time that the parked vehicles require to drive from their new parking position to the entrance area. This may in particular achieve the technical advantage that a parking time for new vehicles may be reduced due to the changed parking distribution.

In general, it is provided according to one aspect or according to one specific embodiment that a trajectory to the parking position is transmitted to the vehicle via the communication network, instead of or in addition to the parking position. The vehicle may then follow the same in particular to arrive at the parking position. Such a trajectory may be ascertained vehicle-externally, in particular with the aid of the device.

According to one specific embodiment, it is provided that the parking position is ascertained by assigning to every possible parking position on the parking lot a length of time for reaching the same starting from the entrance area, and by assigning to every trajectory point of a trajectory leading from the entrance area to the particular parking position a point in time at which a vehicle will pass the same following a start, that parking position being selected as the parking position to be transmitted from the possible parking positions in such a way that the vehicle of the parking inquiry does not block a driving area of a following vehicle when the same crosses a trajectory point of the vehicle of the parking inquiry.

According to one further specific embodiment, it is provided that the parking position is ascertained by selecting, from every possible parking position on the parking lot, that parking position as the parking position to be transmitted which is situated behind a nodal point different from a nodal point situated in front of a parking position for a prior vehicle of a prior parking inquiry.

According to still another specific embodiment, it is provided that the instantaneous and/or expected number of vehicles in the entrance area is compared to a predefined threshold value, that parking position being ascertained corresponding to the two above-described specific embodiments based on the comparison.

According to still another specific embodiment, it is provided that a respective new parking position for parked vehicles is ascertained as a function of a capacity utilization of the parking lot, the new parking positions being transmitted via the communication network to the parked vehicles, so that the parked vehicles may autonomously re-park corresponding to the new parking position.

A parking lot within the meaning of the present invention may also refer to a parking area and serves as a parking area for vehicles. The parking lot thus forms in particular a contiguous surface area which includes multiple parking spots (in the case of a parking lot on private property) or parking spaces (in the case of a parking lot on public property). According to one specific embodiment, the parking lot may also include a parking garage. The parking lot in particular includes a garage.

Autonomously within the meaning of the present invention means in particular that the vehicle drives or navigates independently, i.e., without an intervention of a driver. The vehicle thus independently drives on the parking lot, without a driver having to steer the vehicle to do so. Such an autonomously driving vehicle, which is able to automatically pull into and out of a parking spot, is also referred to as an AVP vehicle, for example. AVP stands for "automatic valet parking" and may be referred to as an "automatic parking process." Vehicles which do not have this AVP functionality are referred to as normal vehicles, for example.

According to one specific embodiment, the communication network includes a WLAN network and/or a mobile communication network.

A drop-off position within the meaning of the present invention is a position at which a driver of the vehicle may drop off his/her vehicle for an autonomous parking process and he/she may pick up his/her vehicle again at a later point in time.

A parking position within the meaning of the present invention is a position in which the vehicle is to autonomously park.

In one specific embodiment, it is provided that the vehicle autonomously drives from the drop-off position to the parking position.

In one further specific embodiment, it is provided that the vehicle autonomously pulls into the (new) parking position.

In one further specific embodiment, it is provided that the vehicle autonomously pulls out of the (new) parking position.

According to one further specific embodiment, it is provided that the vehicle autonomously drives from the (new) parking position to the drop-off position.

In one further specific embodiment, it is provided that the vehicle autonomously drives from the parking position to the new parking position.

According to one specific embodiment, a sensor system is provided which detects a number of the arrived and/or immediately approaching vehicles and makes this information available to the device, for example via the communication network. The sensor system includes, for example, a camera system in the entrance area, which detects a number and a sequence of the vehicles. For example, a vehicle-internal localization unit (for example, GPS and/or having image processing-based landmarks for matching to highly precise localization maps, and the like) is provided, which transmits an instantaneous position of the vehicle to the device, for example in a highly precise georeferenced manner.

Specific embodiments with respect to the method are derived analogously from specific embodiments with respect to the device, and vice versa. This means that corresponding statements and technical advantages and technical features for the device are derived analogously from the corresponding statements in conjunction with the method, and vice versa.

The present invention will be described in greater detail hereafter based on the exemplary embodiments.

DETAILED DESCRIPTION

Figure 1:
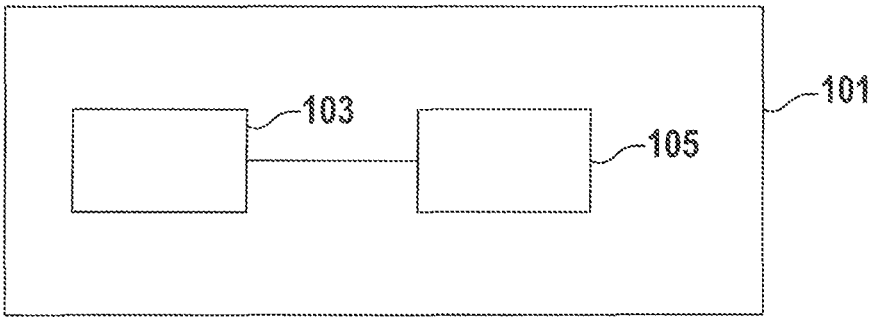
FIG. 1 shows a device for operating a parking lot.

FIG. 1 shows a device 101 for operating a parking lot.

Device 101 includes a communication interface 103, which is configured to receive a parking inquiry for a vehicle in the parking lot from a user of a communication network via the communication network. A parking inquiry within the meaning of the present invention is in particular an inquiry that the vehicle wants to park in the parking lot.

Device 101 furthermore includes a processor 105, which is configured to ascertain a parking position in the parking lot for the vehicle in response to the received parking inquiry. This is carried out based on an instantaneous and/or expected number of vehicles situated in an entrance area of the parking lot.

Communication interface 103 is configured to transmit the ascertained parking position via the communication network to the user so that the vehicle may park in the ascertained parking position.

According to one specific embodiment, the vehicle autonomously parks in the ascertained parking position. This means in particular that the vehicle autonomously drives from a drop-off position to the parking position and parks there.

In particular, the reverse route is provided, that the vehicle autonomously drives from the ascertained parking position back to the drop-off position.

Such a vehicle may in particular also be referred to as an AVP vehicle, i.e., as a vehicle which is able to autonomously drive in a parking lot and autonomously pull into and out of a parking spot.

Figure 2:
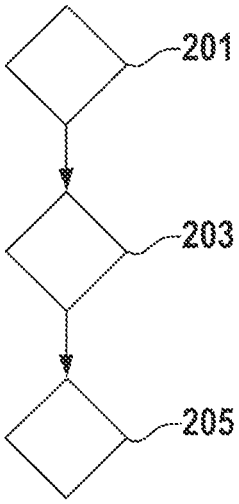
FIG. 2 shows a flow chart of a method for operating a parking lot.

FIG. 2 shows a flow chart of a method for operating a parking lot.

According to a step 201, a parking inquiry for a vehicle in the parking lot is received from a user of a communication network via the communication network. This means that the user of the communication network transmits a parking inquiry, for example to device 101 of FIG. 1, the transmitted inquiry being received according to step 201.

In a step 203, a parking position in the parking lot is ascertained for the vehicle based on an instantaneous and/or expected number of vehicles situated in an entrance area of the parking lot in response to the received parking inquiry. According to a step 205, the ascertained parking position is transmitted via the communication network to the user so that the vehicle may park in the ascertained parking position.

According to one specific embodiment, the user is the vehicle itself. This means that the vehicle transmits a corresponding parking inquiry and receives the ascertained parking position, and subsequently autonomously drives from a drop-off position to the ascertained parking position and autonomously parks there.

Figure 3:
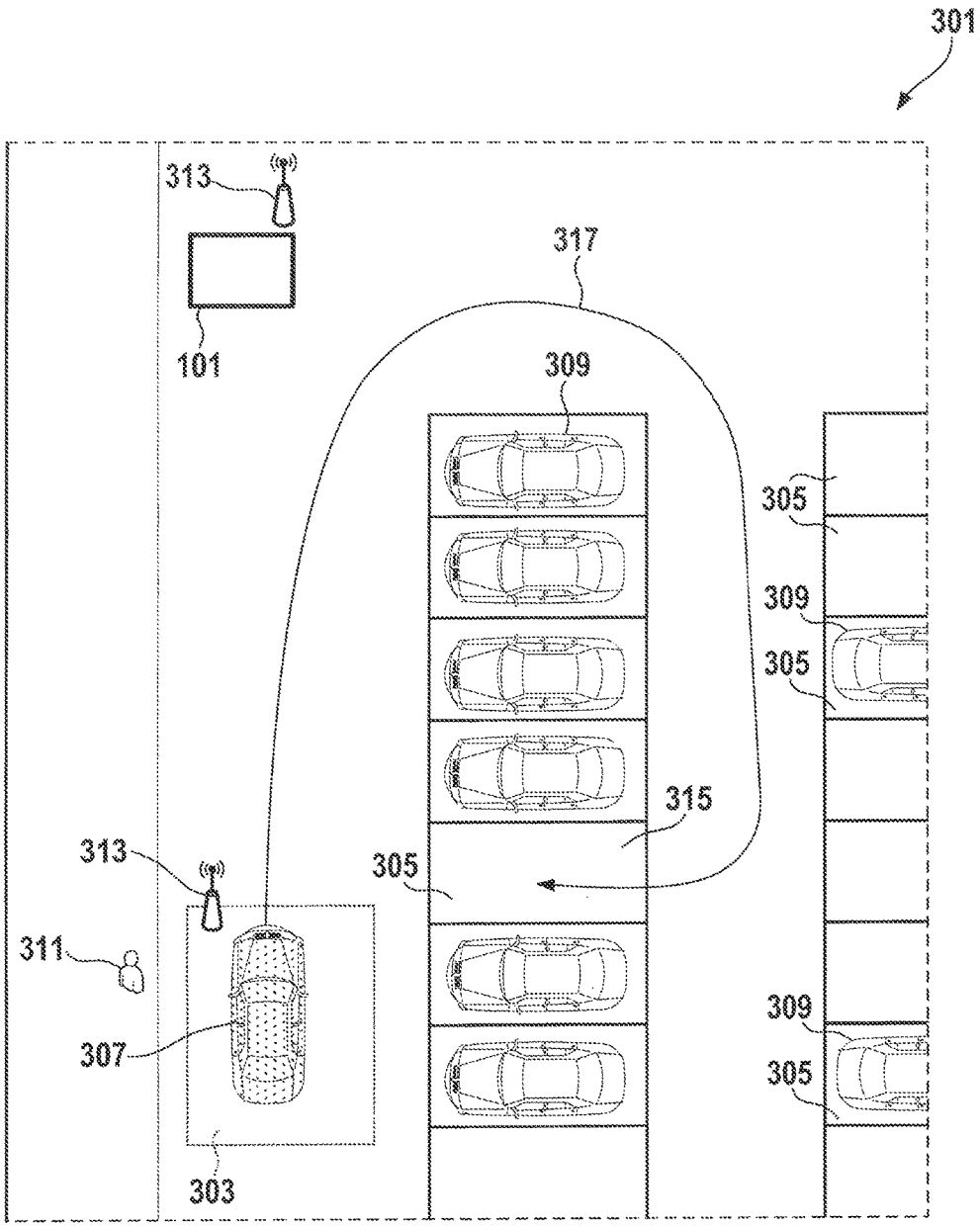
FIG. 3 shows a parking lot.

FIG. 3 shows a parking lot 301.

Parking lot 301 includes a drop-off position 303. Parking lot 301 furthermore includes multiple parking spaces 305. An AVP vehicle 307 has been parked by its driver 311 in drop-off position 303.

Further vehicles 309 have already been parked in parking spaces 305. These further vehicles 309 are in particular also AVP vehicles or normal vehicles.

Parking lot 301 furthermore includes device 101 from FIG. 1. Such a device may in general also be referred to as a parking lot management server or a parking lot management system. This coordinates in particular an assignment of parking spaces 305.

Moreover, a wireless communication network is provided, reference numeral 313 pointing to an icon which symbolically is intended to symbolize the wireless communication network. With the aid of wireless communication network 313, wireless communication is thus possible between device 101 and AVP vehicle 307.

One possible specific embodiment of the present invention is now described hereafter by way of example.

Upon its arrival in parking lot 301, which in general may also be referred to as a parking facility, AVP vehicle 307 registers with device 101 via wireless communication network 313. Driver 311 confirms in the area of drop-off position 303 that device 101 is to park AVP vehicle 307 in the parking facility and leaves the area of drop-off position 303, for example following a prompt by AVP vehicle 307.

Device 101 knows the present capacity utilization of parking lot 301 and occupied or free parking spaces 305. Device 101 ascertains a parking position for AVP vehicle 307, which may also be referred to as a destination position, and transmits this parking position to AVP vehicle 307 via the wireless communication network 313. The ascertainment of the destination position is in particular carried out as was already described above or also as is described hereafter.

It may be provided that also a trajectory 317 for reaching destination position 315 is transmitted, in addition to the destination position. This is carried out in particular using localization landmarks along trajectory 317 required for this purpose.

Destination position 315 is in particular identified as a function of the instantaneous and/or expected vehicle density in the entrance area of parking lot 301.

According to one specific embodiment, a sensor system, which is not shown here, is provided which detects a number of the arrived and/or immediately approaching vehicles and makes this information available to device 101, for example via wireless communication network 313. The sensor system includes, for example, a camera system in the entrance area, which detects a number and a sequence of the vehicles.

For example, a vehicle-internal localization unit (for example, GPS and/or having image processing-based landmarks for matching to highly precise localization maps, and the like) is provided, which transmits an instantaneous position of the vehicle to device 101, for example in a highly precise georeferenced manner.

The vehicle density is based in particular on the number of instantaneous or expected vehicles situated in the entrance area of the parking lot.

According to the present invention, it is provided to modify the selection of destination position 315 of AVP vehicle 307 as a function of the vehicle density in the entrance area.

Such a procedure is necessitated by the time which a fully automatic vehicle requires for parking.

For this purpose, it is to be assumed that usually at least a three point negotiation, however for situational reasons a higher multi-point maneuver, is required to reach a parking spot or a parking space. If, as a simple strategy, destination position 315 which is reachable first from the entrance is always selected for the selection of destination positions 315, the risk is high that the presently parking vehicle, during the multi-point maneuver which is to be carried out, prevents a further vehicle from passing, which cumulatively across all queued parking processes may result in a considerable back-up, including long waiting times.

Furthermore, the constant selection of that free destination position which is situated the farthest away from the entrance would result in an uneconomical situation in the case of a lower number of waiting vehicles (vehicles consume more fuel/energy than necessary) and result in negative experiences for the customers due to longer waiting times for pick-up, for example when they have to wait seemingly long for their vehicle even though the parking garage is almost empty.

Against this background, the method according to the present invention distinguishes between at least two situations as a function of the present vehicle density in front of/at the entrance area:

Low density

Selection of destination positions 315 in the entrance area

According to this specific embodiment, destination position 315 is ascertained using a method which assigns to every destination position 315 the length of time for reaching the same and, simultaneously, assigns to every trajectory point a point in time at which the vehicle passes the same after the start. Having this knowledge, destination position 315 may be selected in such a way that the present vehicle no longer blocks the driving area of the following vehicle when the same crosses a trajectory point of the present vehicle.

High density

Selection of destination position 315 in more remote parking areas

Utilizing the passing of what may be a large number of nodal points (Traffic nodal points, such as ramps, whereby further parking garage levels or the present level including its parking areas may be reached)

The successively following vehicles always locating destination positions 315 in parking areas situated behind other nodal points A tree, for example, results as the data structure, the roots representing the entrance area. The following nodes describe traffic nodal points having turnoffs, and the edges between the nodes may be labeled with distances and required times until the subsequent nodes are reached. In one specific embodiment, the method fills the free destination positions which are situated on the leaves of the tree.

Further methods are derived from the use of further optimization methods.

Moreover, it is provided in one further specific embodiment that vehicles re-park under the changing capacity utilization of the parking lot (a parking garage, for example). Since drivers, for example, could gain the impression that the capacity utilization of the parking garage is low as a function of the vehicles being picked up with the aid of the throughput-optimized identification of destination position 315 of a parking lot management system of a valet parking system, while the few vehicles are situated rather far removed from the entrance area (or are not skillfully distributed for the optimization method in the event of a new "onrush"), it is advantageous to assign new destination positions 315 to the vehicles corresponding to the optimization criterion.

The advantage of the present invention is in particular the reduction in the waiting time of a driver when surrendering the vehicle to device 101, for example during major events such as a soccer game or the like.

Furthermore, longer waiting times and the inconvenience associated therewith are avoided when the capacity utilization of the parking facility is lower—where the driver could ask why he/she has to wait seemingly long for his/her vehicle, even though the parking garage is empty.

Furthermore, the method may contribute to avoiding unnecessary resource consumption by selecting destination positions 315 in the entrance area of the parking facility in the case of lower vehicle density, and thus avoiding fuel/energy consumption due to unnecessarily long trips.

Figure 4:
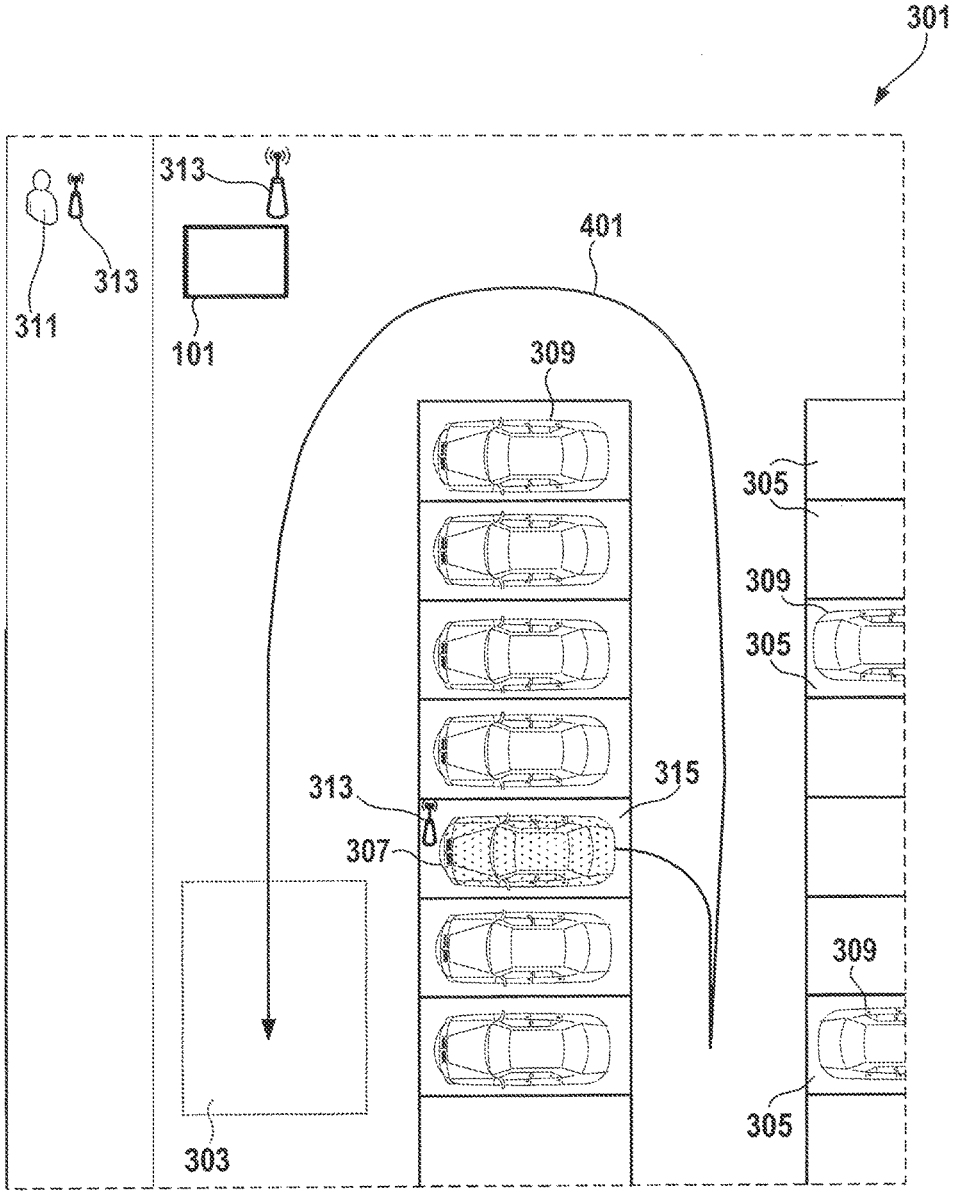
FIG. 4 shows the parking lot of FIG. 3 at a later point in time.

Coming back to FIGS. 3 and 4, i.e., that according to FIG. 3 driver 311 leaves his/her AVP vehicle 307 in the area of the drop-off position 303 and is able to attend to other things, for example, such as a start of a flight, shopping, or a visit to the movies. AVP vehicle 307 previously registered with device 101 and received an affirmation of a free spot, here the parking position or destination position 315. Based on the destination coordinates and a topological description of the traffic routes, a trajectory 317, i.e., a global path, is calculated, which is set by a longitudinal guidance and a transverse guidance of AVP vehicle 307. With the aid of a vehicle-internal sensor system, for example a surroundings sensor, it is ensured that route 317, which is to say the initial leg, is drivable and, if necessary, which may be a local path is planned to avoid collisions. When AVP vehicle 307 has reached its destination position 315 (or parking position), it permanently shuts itself off until it is ordered back directly to drop-off position 303 by device 101 or by driver 311.

This is shown in FIG. 4. Driver 311 approaches drop-off position 303 and either directly orders his/her vehicle 307 back or registers this with device 101, which then orders vehicle 307 back, i.e., when driver 311 wants to drive on again, he/she may notify device 101 of this, for example via a smart phone application, which transmits a start signal to AVP vehicle 307 and, for example, a trajectory, which vehicle 307 sets in order to reach drop-off position 303 again. Reference numeral 401 points to the trajectory leading from parking position 315 back to drop-off position 303.

In summary, the present invention in particular allows an optimization (for example, a maximization) of the passage times of vehicles having an automated valet parking function (i.e., AVP vehicles) through the entrance area of a parking lot (for example of a parking garage provided for this purpose or parking surroundings of a general type). Advantages according to the present invention are in particular an avoidance of holding times of the vehicles in the entrance area and a back-up of vehicles associated therewith on potentially public roads, and the inconvenient effects associated therewith on the drivers of these vehicles. This means in particular that, for this purpose, the destination position of an entering vehicle is selected in such a way that the holding time of further arriving or already present vehicles is avoided or minimized.

What is claimed is:

1. A device for operating a parking lot, comprising:

a communication interface to receive a parking inquiry for a vehicle in the parking lot from a user of a communication network via the communication network; and a processor, which, in response to the received parking inquiry, is configured to ascertain a parking position in the parking lot for the vehicle based on an instantaneous and/or expected number of vehicles situated in an entrance area of the parking lot;

wherein the communication interface is configured to transmit the ascertained parking position via the communication network to the user so that the vehicle may park in the ascertained parking position, wherein the processor is configured to ascertain the parking position in that the processor assigns to every possible parking position in the parking lot an associated length of time for reaching the associated possible parking position from the entrance area, and assigns to every particular trajectory point of a trajectory leading from the entrance area to a particular parking position a point in time at which a vehicle will pass a particular trajectory point following a start, the ascertained parking position to be transmitted being selected from the possible parking positions so that the vehicle of the parking inquiry does not block a driving area of a following vehicle when the same crosses a trajectory point of the vehicle of the parking inquiry, and wherein the processor is configured to ascertain the parking position in that the processor selects, from the possible parking positions in the parking lot, that parking position as the parking position to be transmitted which is situated behind a nodal point which is different from a nodal point situated in front of a parking position for a prior vehicle of a prior parking inquiry.

2. The device of claim 1, wherein the processor is configured to compare the instantaneous and/or expected number of vehicles in the entrance area to a predefined threshold value, the processor being configured to ascertain the parking position based on the comparison.

3. The device of claim 1, wherein the processor is configured to ascertain respective new parking positions for parked vehicles as a function of a capacity utilization of the parking lot, the communication interface being configured to transmit the new parking positions via the communication network to the parked vehicles so that the parked vehicles may autonomously re-park corresponding to the new parking position.

4. The device of claim 1, wherein the processor determines whether a vehicle density at the entrance area is one of a first value and a second value, the second value being higher than the first value, and wherein the processor ascertains the parking position on the basis of whether the vehicle density at the entrance area is one of the first value and the second value.

5. A method for operating a parking lot, the method comprising:

receiving a parking inquiry for a vehicle in the parking lot is received from a user of a communication network via the communication network; and ascertaining, in response to the received parking inquiry, a parking position in the parking lot for the vehicle based on an instantaneous and/or expected number of vehicles situated in an entrance area of the parking lot;

wherein the ascertained parking position is transmitted via the communication network to the user so that the vehicle may park in the ascertained parking position, wherein the parking position is ascertained by assigning to every possible parking position in the parking lot an associated length of time for reaching the associated possible parking position from the entrance area, and by assigning to every particular trajectory point of a trajectory leading from the entrance area to a particular parking position a point in time at which a vehicle will pass a particular trajectory point following a start, the ascertained parking position to be transmitted being selected from the possible parking positions so that the vehicle of the parking inquiry does not block a driving area of a following vehicle when the same crosses a trajectory point of the vehicle of the parking inquiry, and wherein the parking position is ascertained in that, from the possible parking positions in the parking lot, that parking position is selected as the parking position to be transmitted which is situated behind a nodal point which is different from a nodal point situated in front of a parking position for a prior vehicle of a prior parking inquiry.

6. The method of claim 5, wherein the instantaneous and/or expected number of vehicles in the entrance area is compared to a predefined threshold value, the parking position being ascertained based on the comparison.

7. The method of claim 5, wherein respective new parking positions for parked vehicles is ascertained as a function of a capacity utilization of the parking lot, the new parking positions being transmitted via the communication network to the parked vehicles so that the parked vehicles may autonomously re-park corresponding to the new parking position.

8. The method of claim 5, further compromising determining whether a vehicle density at the entrance area is one of the first value and the second value, the second value being higher than the first value, wherein the ascertaining of the parking position depends on whether the vehicle density at the entrance area is one of the first value and the second value.

9. A non-transitory computer readable medium having a computer program, which is executable by a processor, comprising:

a program code arrangement having program code for operating a parking lot, by performing the following:

receiving a parking inquiry for a vehicle in the parking lot is received from a user of a communication network via the communication network; and ascertaining, in response to the received parking inquiry, a parking position in the parking lot for the vehicle based on an instantaneous and/or expected number of vehicles situated in an entrance area of the parking lot;

wherein the ascertained parking position is transmitted via the communication network to the user so that the vehicle may park in the ascertained parking position, wherein the parking position is ascertained by assigning to every possible parking position in the parking lot an associated length of time for reaching the associated possible parking position from the entrance area, and by assigning to every particular trajectory point of a trajectory leading from the entrance area to a particular parking position a point in time at which a vehicle will pass a particular trajectory point following a start, the ascertained parking position to be transmitted being selected from the possible parking positions so that the vehicle of the parking inquiry does not block a driving area of a following vehicle when the same crosses a trajectory point of the vehicle of the parking inquiry, and wherein the parking position is ascertained in that, from the possible parking positions in the parking lot, that parking position is selected as the parking position to be transmitted which is situated behind a nodal point which is different from a nodal point situated in front of a parking position for a prior vehicle of a prior parking inquiry.

10. The non-transitory computer readable medium of claim 9, wherein the program code arrangement determines whether a vehicle density at the entrance area is one of a first value and a second value, the second value being higher than the first value, and wherein the ascertaining of the parking position depends on whether the vehicle density at the entrance area is one of the first value and the second value.

* * * * *